US006061426A

United States Patent [19]

Linders et al.

[11] Patent Number: 6,061,426

[45] Date of Patent: May 9, 2000

[54] X-RAY EXAMINATION APPARATUS INCLUDING AN X-RAY FILTER

[75] Inventors: Petrus W. J. Linders; Herman Stegehuis; Wilhelmus J. J. Welters; Nicolaas P. Willard; Lambertus G. J. Fokkink, all of Eindhoven, Netherlands

[73] Assignee: U.S. Philips Corporation, New York, N.Y.

[21] Appl. No.: 09/166,432

[22] Filed: Oct. 5, 1998

[30] Foreign Application Priority Data

Oct. 6, 1997 [EP] European Pat. Off. ..... 97203099

[51] Int. Cl.[7] ..... G21K 1/02

[52] U.S. Cl. ..... 378/149; 378/150; 378/151; 378/156; 378/159

[58] Field of Search ..... 378/149–151, 378/156–159

[56] References Cited

U.S. PATENT DOCUMENTS 3,805,081 4/1974 Barthel et al. ..... 378/149

FOREIGN PATENT DOCUMENTS 8903110 7/1991 Netherlands ..... H05G 1/64
WO9613040 5/1996 WIPO ..... G21K 3/00
WO9703450 1/1997 WIPO ..... G21K 3/00

*Primary Examiner*—Craig E. Church
*Attorney, Agent, or Firm*—Dwight H. Renfrew, Jr.

[57] ABSTRACT

An X-ray examination apparatus includes an X-ray source (1) for emitting X-rays. An object to be radiologically examined is arranged in an examination space. An X-ray detector (2) derives an image signal, for example an electronic video signal, from an X-ray image of the object. An X-ray filter locally attenuates the X-rays partly. The X-ray filter is arranged between the X-ray source and the X-ray detector and the X-ray filter is provided with filter elements whose X-ray absorptivity can be adjusted on the basis of an amount of X-ray absorbing liquid present within the individual filter elements.

The X-ray examination apparatus includes an X-ray collimator for locally intercepting the X-rays. The X-ray collimator is arranged between the X-ray source and the examination space and is provided with collimator elements which can be switched between an X-ray transmitting state and an X-ray intercepting state. Individual collimator elements are filled with an X-ray intercepting liquid in the X-ray intercepting state.

The amount of X-ray absorbing liquid present in the filter elements is controlled by application of an electric voltage to the relevant filter elements. The collimator elements are switched between the X-ray intercepting state and the X-ray transmitting state by means of an electric voltage which is applied to the relevant collimator elements.

11 Claims, 4 Drawing Sheets

X-RAY EXAMINATION APPARATUS INCLUDING AN X-RAY FILTER

BACKGROUND OF THE INVENTION

1. Field of the Invention

The invention relates to an X-ray apparatus which includes an X-ray source for emitting X-rays, an examination space for receiving an object to be radiologically examined, an X-ray detector for deriving an image signal from an X-ray image of the object, and an X-ray filter for locally attenuating the X-rays, which X-ray filter is arranged between the X-ray source and the X-ray detector, and is provided with filter elements whose X-ray absorptivity can be adjusted on the basis of a quantity of X-ray absorbing liquid within the individual filter elements.

2. Description of Related Art

An X-ray examination apparatus of this kind is known from international patent application WO 96/13040.

The known X-ray examination apparatus includes an X-ray filter whose filter elements are constructed as capillary tubes. One end of the capillary tubes communicates with a reservoir containing an X-ray absorbing liquid. The quantity of X-ray absorbing liquid within the individual capillary tubes is controlled on the basis of an electric adjusting voltage applied to the individual capillary tubes. Capillary tubes filled with an X-ray absorbing liquid partly attenuate X-rays passing through the relevant tubes. In the known X-ray examination apparatus it is not easily possible to shield the object to be radiologically examined, for example a patient to be examined, properly from the X-rays in areas of the patient that need not be exposed. In the known X-ray examination apparatus it is notably not very well possible to form an X-ray beam which is limited so as to expose only a predetermined part of the patient. The part to be exposed is chosen, for example on the basis of the suspected disorder of the patient to be examined.

SUMMARY OF THE INVENTION

It is an object of the invention to provide an X-ray examination apparatus which includes an X-ray filter which is provided with filter elements whose X-ray absorptivity can be adjusted on the basis of a quantity of X-ray absorbing liquid within the individual filter elements and is suitable for generating a limited X-ray beam so as to irradiate a predetermined part of the patient.

This object is achieved by means of an X-ray examination apparatus according to the invention which is characterized in that the X-ray examination apparatus includes an X-ray collimator for locally intercepting the X-rays,

- which X-ray collimator is arranged between the X-ray source and the examination space, and
- is provided with collimator elements which can be switched between an X-ray transmitting state and an X-ray intercepting state,
- individual collimator elements being filled with an X-ray intercepting liquid in the X-ray intercepting state.

Due to differences in the X-ray absorption within the object to be examined, for example a patient to be radiologically examined who is accommodated in the examination space, an X-ray image is formed of a part of the patient which is irradiated by X-rays. The X-ray image is formed on an X-ray-sensitive surface of an X-ray detector which is arranged opposite the X-ray source. The examination space is situated between the X-ray source and the X-ray detector.

Collimator elements filled with the X-ray intercepting liquid do not transmit X-rays whereas collimator elements which are not filled with the X-ray intercepting liquid transmit X-rays practically without attenuation. When parts of the X-ray beam emitted by the X-ray source are allowed to be intercepted by the collimator elements filled with the X-ray intercepting liquid, it can be achieved that practically only the part of the patient that is to be irradiated is indeed exposed to X-rays, so that the X-rays are prevented from reaching parts of the patient which need not be imaged. The X-ray collimator can be adjusted as desired by filling collimator elements with the X-ray intercepting liquid or not, thus setting the collimator elements either to the X-ray intercepting state or to the X-ray transmitting state. Because the collimator elements can be individually adjusted, a high degree of freedom exists as regards the interception of parts of the X-ray beam. It is notably possible to intercept parts of the X-ray beam within its cross-section, so that "islands" which are not traversed by X-rays are formed within the cross-section of a limited beam.

The X-ray filter to a certain degree attenuates parts of the X-ray beam which pass through parts of the patient which have a low X-ray absorptivity whereas parts of the X-ray beam which pass through parts of the patient having a high absorptivity are not at all attenuated or only hardly so. The X-ray filter thus ensures that the dynamic range of the X-ray image remains limited. The dynamic range of the X-ray image, or of a series of successive images, is the interval between the highest and the lowest brightness value of the X-ray image or the series of X-ray images. Because the dynamic range of the X-ray image is limited, the X-ray image can be readily processed, without significant disturbances, so as to reproduce the image information of the X-ray image, for example as an image on a monitor. The X-ray filter is notably adjusted in such a manner that it yields an X-ray image which has a dynamic range which lies within a given interval which is not larger, or only hardly larger, than the range of brightness values in the X-ray image which represent medically relevant image information. Small details of low contrast can thus be reproduced in a suitably visible manner, so that the X-ray image constitutes an effective technical diagnostic aid for diagnosis.

The X-ray collimator and the X-ray filter are both adjusted on the basis of respective quantities of X-ray intercepting and X-ray absorbing liquids in collimator elements and filter elements. Because the X-ray collimator and the X-ray filter are adjusted in a similar manner, it is comparatively simple to adjust the X-ray collimator and the X-ray filter by means of one and the same adjusting unit or by means of separate adjusting units operating in a similar manner. It is notably advantageous that it is not necessary to utilize a plurality of adjusting units operating in very different ways. It is possible notably to adjust the X-ray collimator as well as the X-ray filter on the basis of electric adjusting voltages applied to collimator elements and filter elements, respectively. The electric adjusting voltage is in this case the electric potential difference between the X-ray absorbing or X-ray intercepting liquids and the walls of the relevant filter element or collimator element. Furthermore, the X-ray collimator does not include any mechanically movable parts which would have to be adjusted to desired positions during the adjustment of the X-ray collimator.

It is also an advantage that the X-ray collimator and the X-ray filter are constructed in the same, at least quite similar manner. Consequently, it is easier, and hence less expensive, to manufacture X-ray collimators and X-ray filters for X-ray examination apparatus.

Liquid metals, such as mercury and gallium, intercept X-rays substantially completely. Even a collimator element formed by a short capillary tube, having length of from some millimeters to some centimeters, will intercept X-rays substantially completely when filled with such a liquid metal. A column mercury of a length of 3 mm absorbs X-rays with an energy of between 50 keV and 125 keV almost completely; when gallium is used, a column of approximately from 20 to 30 mm will be required so as to achieve practically complete absorption of X-rays. Furthermore, cesium, indium and rubidium have a comparatively low melting point and a significant X-ray absorptivity, so that they are suitable materials for use as the X-ray absorbing liquid metal. When such a capillary tube does not contain the liquid metal, it transmits the X-rays substantially without attenuation. Therefore, collimator elements, notably capillary tubes, can be adjusted to the X-ray intercepting state by filling them with a liquid metal and to the X-ray transmitting state by evacuating the capillary tubes.

When short capillary tubes are used for the collimator elements, they can be very quickly switched from the X-ray transmitting state to the X-ray intercepting state. It has been found that, depending on the length of the collimator elements, only from 1 to 10 ms are required for the switching of the collimator elements. The filter elements are preferably somewhat longer capillary tubes, so that the degree of X-ray absorptivity of the individual filter elements can be adjusted within a given range by control of the quantity of X-ray absorbing liquid within the filter elements. Suitable results in respect of a fast adjustment of the X-ray collimator and an adequate range for adjustment of the X-ray filter are obtained by utilizing filter elements having a length of tens of millimeters and collimator elements having a length of a few millimeters. The length of the collimator elements amounts to from approximately 1/10 to 1/2 of the length of the filter elements. For example, a lead nitrate solution in water is used as the X-ray absorbing liquid while mercury is used as the X-ray intercepting liquid. In that case the filter elements preferably have a length of 12 mm and the collimator elements a length of approximately 3 mm; the length of the collimator elements then amounts to approximately 1/4 to less than 1/3 of the length of the filter elements.

When use is made of a small number of collimator elements, preferably in the form of capillary tubes, the adjusting time required for adjusting the X-ray collimator will be reduced further. It has been found that no high spatial resolution is required for the X-ray collimator; this means that it has been found that it is not necessary to intercept parts of the X-ray beam which have a very small cross-section. Consequently, so as to benefit from the short adjusting time it is advantageous to decrease the spatial resolution of the X-ray collimator by utilizing a smaller number of individual collimator elements. Suitable results are obtained, for example by utilizing 128×128 collimator elements. In order to achieve an attractive spatial resolution of the X-ray filter, preferably 256×256 or even 512×512 filter elements are used. The number of collimator elements then amounts to only approximately 1/8 or 1/16 part of the number of filter elements.

Preferably, the collimator elements communicate with the reservoir containing the X-ray intercepting liquid via a common duct. Furthermore, the X-ray collimator preferably includes an evacuation system for evacuating the common duct. The X-ray intercepting liquid, such as the liquid metal, is fed to or from the collimator elements via the common duct. The common duct preferably communicates with a reservoir for the X-ray intercepting liquid. The evacuation system enables removal of the X-ray intercepting liquid from the common duct. After evacuation of the common duct, it no longer leads to undesirable interception of X-rays.

The evacuation system includes, for example an electrically conductive layer which is provided on the wall of the common duct and is isolated from the X-ray intercepting liquid by electric insulation. Application of an electric voltage to the electrically conductive layer of the common duct reduces the adhesion between the wall of the common duct and the X-ray intercepting liquid to such an extent that the common duct becomes hydrophobic as regards the X-ray intercepting liquid which then flows out of the common duct, for example under the influence of gravity. After the common duct has been evacuated, it will intercept hardly any X-rays. Thus, X-rays will be intercepted practically exclusively by the collimator elements filled with the X-ray intercepting liquid. It is notably possible to avoid the undesirable interception of parts of the X-ray beam by X-ray intercepting liquid left behind in the common duct.

The evacuation system may also include a system of pistons and valves whereby the X-ray intercepting liquid can be pneumatically forced out of the common duct.

Suitable results in respect of the removal of the X-ray absorbing intercepting liquid from the common duct are achieved notably by reduction of the volume of the common duct. Distortion of the common duct reduces its volume, thus forcing the X-ray intercepting liquid from the common duct to the reservoir. The common duct can be readily distorted when use is made of a deformable wall. Deformation of the deformable wall forces any remaining X-ray liquid out of the common duct. The distortion can be achieved very well by means of electromechanical means, for example by means of a system of miniature motors for exerting a force on the deformable wall.

When the X-ray collimator is arranged between the examination space and the X-ray filter, the X-ray collimator will intercept X-rays which have been scattered in the X-ray filter. It is thus achieved that X-rays scattered by the X-ray filter will not disturb the X-ray image. Notably blurring of the X-ray image by X-rays scattered by the X-ray filter is thus avoided.

When the X-ray collimator is arranged between the X-ray source and the X-ray filter, it is achieved that the distance between the X-ray collimator and the X-ray source is only small, notably much smaller than the distance between the X-ray source and the X-ray detector. It is thus achieved that modulations of the intensity of the X-rays over short distances, as caused by the X-ray collimator, are spread over larger distances in the X-ray image by the diverging X-ray beam, so that they do not affect the X-ray image or only hardly so. Such differences occur at areas where neighboring collimator elements are in the X-ray transmitting state and in the X-ray intercepting state. Notably differences in the intensity of the X-rays over distances amounting to a fraction of a millimeter in the direction transversely of the X-ray beam at the area of the X-ray collimator are spread to a high degree at the area of the X-ray detector.

BRIEF DESCRIPTION OF THE DRAWINGS

These and other aspects of the invention will be apparent from and elucidated with reference to the embodiments described hereinafter and the accompanying drawing; therein.

DETAILED DESCRIPTION OF THE PREFERRED EMBODIMENT

Figure 1:
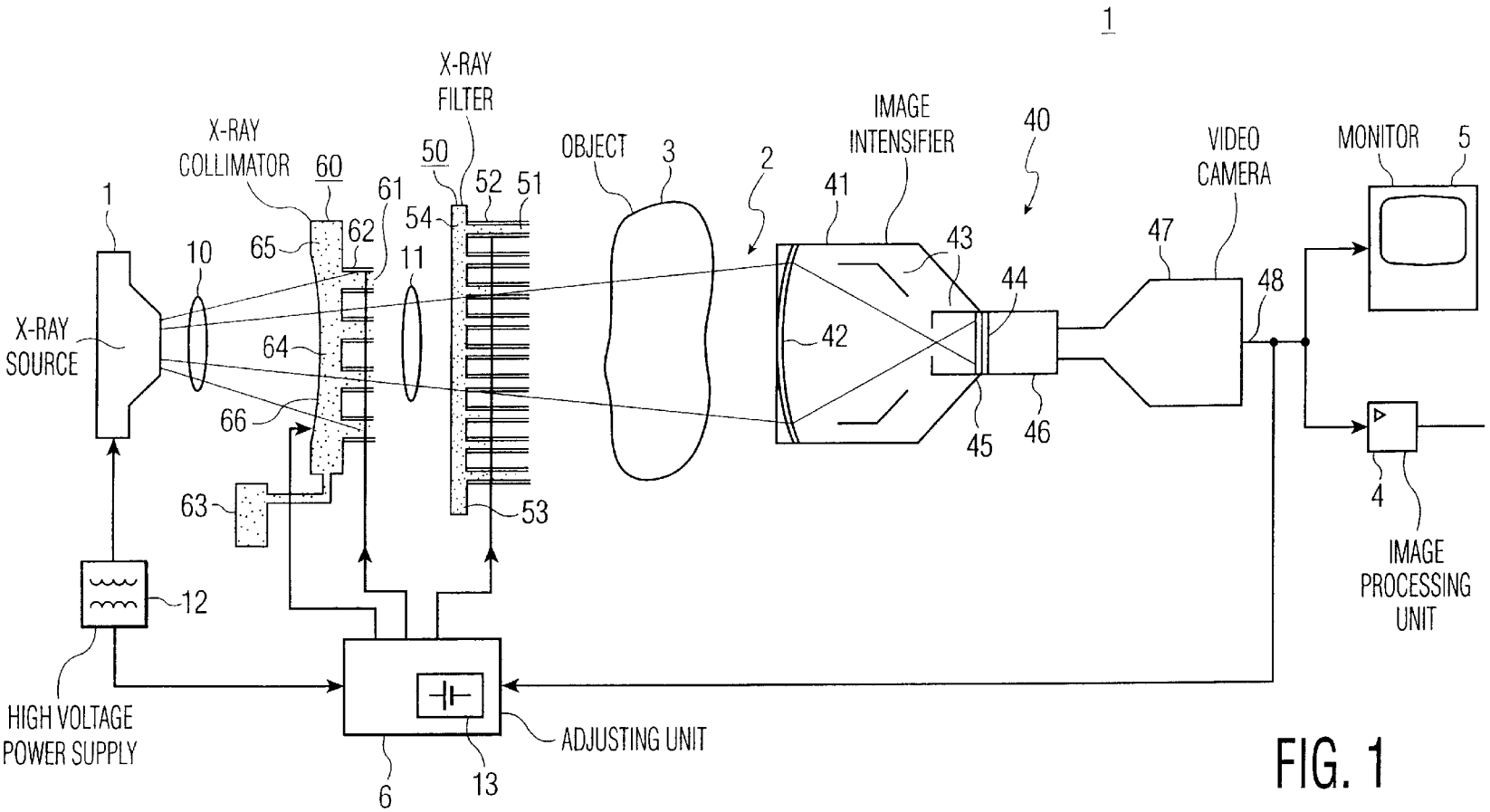
FIG. 1 is a diagrammatic representation of an X-ray examination apparatus according to the invention.

FIG. 1 shows diagrammatically an X-ray examination apparatus according to the invention. The X-ray source 1 emits an X-ray beam 10 for irradiating the object 3. Due to differences in X-ray absorption within the object 3, for example a patient to be radiologically examined, an X-ray image is formed on an X-ray sensitive surface 42 of the X-ray detector 40 which is arranged opposite the X-ray source. The object 3 is accommodated in the examination space 2. For example, a patient table on which the patient is positioned during the irradiation is arranged in the examination space. The X-ray detector 40 of the present embodiment is formed by an image intensifier pick-up chain which includes an X-ray image intensifier 41 for converting the X-ray image into an optical image on an exit window 44 and a video camera 47 for picking up the optical image. The entrance screen 42 acts as the X-ray sensitive surface of the X-ray image intensifier which converts incident X-rays into an electron beam which is imaged on the exit window by means of an electron optical system 43. The incident electrons generate the optical image on a phosphor layer 45 of the exit window 44. The video camera 47 is coupled to the X-ray image intensifier 41 by way of an optical coupling 46, for example a lens system or a fiber-optical coupling. The video camera 47 derives an image signal, for example an electronic video signal, from the optical image, which signal is applied to a monitor 5 for the display of the image information in the X-ray image. The image signal may also be applied to an image processing unit 4 for further processing.

Between the X-ray source 1 and the object 3 in the examination space 2 there is arranged the X-ray filter 50 for locally attenuating of the X-ray beam. The X-ray filter 50 comprises a large number of filter elements 51 in the form of capillary tubes whose X-ray absorptivity can be adjusted by application of an electric voltage, referred to hereinafter as adjusting voltage, to the inner side of the individual capillary tubes by means of the adjusting unit 6. The adhesion of the X-ray absorbing liquid to the inner side of the individual capillary tubes can be adjusted by means of an electric voltage to be applied to a metal layer, i.e. an electrically conductive layer 52, provided on the inner side of the capillary tubes 51. One end of the capillary tubes 51 communicates with a reservoir 53 for an X-ray absorbing liquid. The reservoir 53 may be a common duct with which the capillary tubes communicate, but use may also be made of a separate reservoir whereto the capillary tubes are connected via a common duct. The capillary tubes are filled with a given quantity of X-ray absorbing liquid as a function of the electric adjusting voltage applied to the individual tubes. Because the capillary tubes extend approximately parallel to the X-ray beam, the X-ray absorptivity of the individual capillary tubes is dependent on the relative quantity of X-ray absorbing liquid present in such a capillary tube. The electric adjusting voltage applied to the individual filter elements is adjusted by means of the adjusting unit 6, for example on the basis of brightness values in the X-ray image and/or the setting of the X-ray source 1; to this end, the adjusting unit is coupled to the output terminal 48 of the video camera and to the high-voltage power supply 12 of the X-ray source 1. The construction of an X-ray filter 50 of this kind and the composition of the X-ray absorbing liquid are described in greater detail in international patent applications WO 96/13040 and WO 97/03450.

Between the X-ray source 1 and the object 3 in the examination space 2 there is also arranged the X-ray collimator 60 which serves to intercept a part of the X-ray beam 10. The X-ray collimator transmits a limited X-ray beam. The limited X-ray beam is shaped in such a manner that the X-rays can reach only a part to be irradiated of the patient 3 to be examined. In other words, the X-ray collimator is adjusted in such a manner that the cross-section of the limited X-ray beam accurately corresponds to the patient area to be irradiated. Such an area to be irradiated is selected in advance. The X-ray collimator 60 includes a large number of collimator elements 61 in the form of capillary tubes which can be adjusted to an X-ray intercepting state and to an X-ray transmitting state by application, using the adjusting unit 6, of an electric voltage, referred to hereinafter as adjusting voltage, to the inner side of the capillary tubes. Capillary tubes 61 whereto an electric adjusting voltage is applied are filled with an X-ray intercepting liquid so that they substantially completely intercept the X-rays incident on such a filled collimator element. Suitable X-ray intercepting liquids are notably liquid metals such as gallium and mercury. When gallium is used, the temperature of the X-ray collimator is maintained above the melting point (29.8° C.), so that the gallium does not solidify. The melting point of mercury is approximately −38.8° C., so that the X-ray collimator can operate at room temperature when mercury is used. The adhesion of the X-ray intercepting liquid to the inner side of the capillary tubes can be adjusted by means of an electric voltage which can be applied to a metal layer, i.e. an electrically conductive layer 62, provided on the inner side of the capillary tubes 61. One end of the capillary tubes communicates with a reservoir 63 for the X-ray intercepting liquid. The reservoir 63 is connected to the collimator elements 61 via a common duct 64. The capillary tubes are filled with the X-ray intercepting liquid as a function of the electric adjusting voltage applied to the individual tubes. The electric adjusting voltage applied to the collimator elements 61 is adjusted by the adjusting unit 6. Because the adjusting unit 6 is coupled to the output terminal 48 of the video camera, the X-ray collimator can be adjusted on the basis of the X-ray image.

The common duct 64 of the X-ray collimator has a flexible wall 66. After adjustment of the X-ray collimator, the flexible wall is pressed against the facing rigid wall of the common duct 64 so as to force the X-ray intercepting liquid from the duct to the reservoir 63. Because the common duct is empty when the X-ray collimator has been adjusted, undesirable interception of X-rays by X-ray intercepting liquid left behind in the common duct is avoided.

The X-ray collimator 60 and the X-ray filter 50 are adjusted in similar ways, that is to say by application of electric adjusting voltages to collimator elements and filter elements, respectively. This allows for the use of a common adjusting unit 6. Furthermore, in practice it is easy to integrate the X-ray collimator 60 and the X-ray filter 50 in a collimator/filter unit.

The X-ray filter includes a large number of, for example 256×256 or 512×512 filter elements which are arranged in a two-dimensional matrix. The X-ray collimator includes a number of, for example 128×128 collimator elements which are also arranged in a two-dimensional matrix. The individual filter elements as well as the individual collimator elements can be adjusted by way of a matrix control system which includes voltage leads for separate columns of filter elements or collimator elements in order to apply an electric adjusting voltage to filter elements or collimator elements of the relevant column. Such a matrix control system also includes control leads for individual rows of filter elements or collimator elements. When control voltages are applied to such control leads, filter elements or collimator elements of the relevant row are selected so as to be adjusted to the electric adjusting voltage carried by the voltage lead whereto said filter elements or collimator elements are connected. The electric adjusting voltages applied to the voltage leads are generated by a voltage source 13 which is included in the adjusting unit 6. The control voltages for adjusting the X-ray filter and the X-ray collimator are also supplied by the adjusting unit 6.

Figure 2:
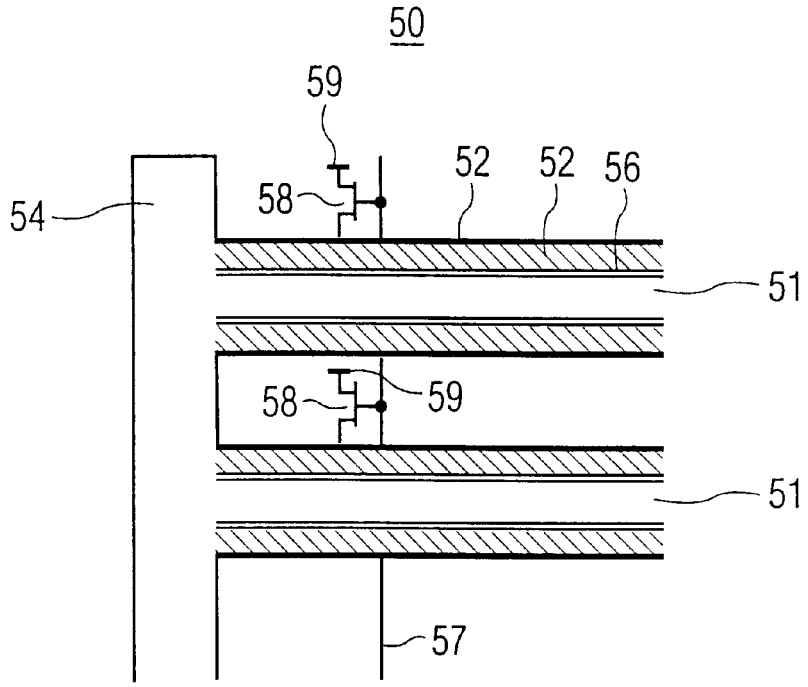
FIG. 2 shows a detail of the X-ray filter of the X-ray examination apparatus of FIG. 1.

FIG. 2 shows a detail of the X-ray filter of the X-ray examination apparatus of FIG. 1. FIG. 2 notably shows that the wall of the individual filter elements is provided with a metal layer 52 of, for example ITO (indium tin oxide) or aluminium whereto the electric adjusting voltage can be applied. On the metal layer 52 there is provided a dielectric layer 55, for example a parylene layer. The dielectric layer counteracts electric breakdowns between the X-ray absorbing liquid 54 and the metal layer 52. A thin parylene layer, for example thinner than 10 $\mu$m, constitutes a particularly suitable dielectric layer. On the thin parylene layer there is preferably provided a PTFE (Teflon) or silane or siloxane coating layer 56 so as to ensure that the collimator elements have a suitable degree of adhesion to the liquid metal as a function of the electric voltage applied. Individual filter elements are connected, by way of their metal layer 52, to a voltage lead 59, via a switching element 58. The switching element is, for example a thin-film transistor 58. The thin-film transistor is closed, i.e. turned on, by application of an electric control voltage to the gate contact of the thin-film transistor. Such an electric control voltage is applied to the relevant thin-film transistor via a control lead 57.

Figure 3:
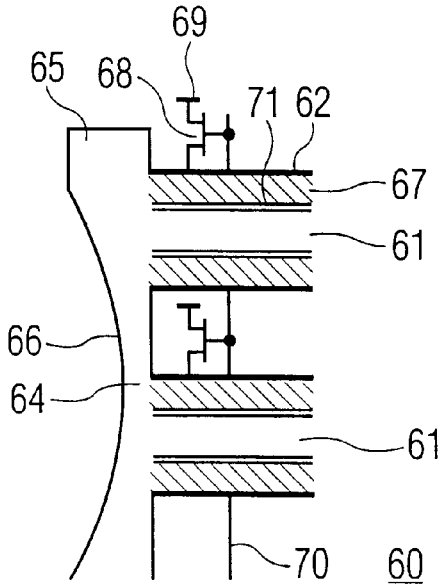
FIG. 3 shows a detail of the X-ray collimator of the X-ray examination apparatus of FIG. 1, and FIGS. 4 and 5 show diagrammatically different configurations of an X-ray examination apparatus provided with an X-ray filter and an X-ray collimator according to the invention.

FIG. 3 shows a detail of the X-ray collimator of the X-ray examination apparatus shown in FIG. 1. FIG. 3 notably shows that the wall of the individual collimator elements is provided with a metal layer 62 whereto the electric adjusting voltage can be applied. On the metal layer 62 there is provided a dielectric layer 64, for example a parylene layer. The dielectric layer counteracts electric breakdowns between the X-ray intercepting liquid 65 and the metal layer 62. On the dielectric layer there is provided a hydrophobic PTFE (Teflon) coating layer 71. Individual filter elements are connected, by way of their metal layer 62, to a voltage lead 69, via a switching element 68. The switching element is, for example a thin-film transistor 68. The thin-film transistor is closed, i.e. turned on, by application of an electric control voltage to the gate contact of the thin-film transistor. Such an electric control voltage is applied to the relevant thin-film transistor via a control lead 70.

Figure 4:
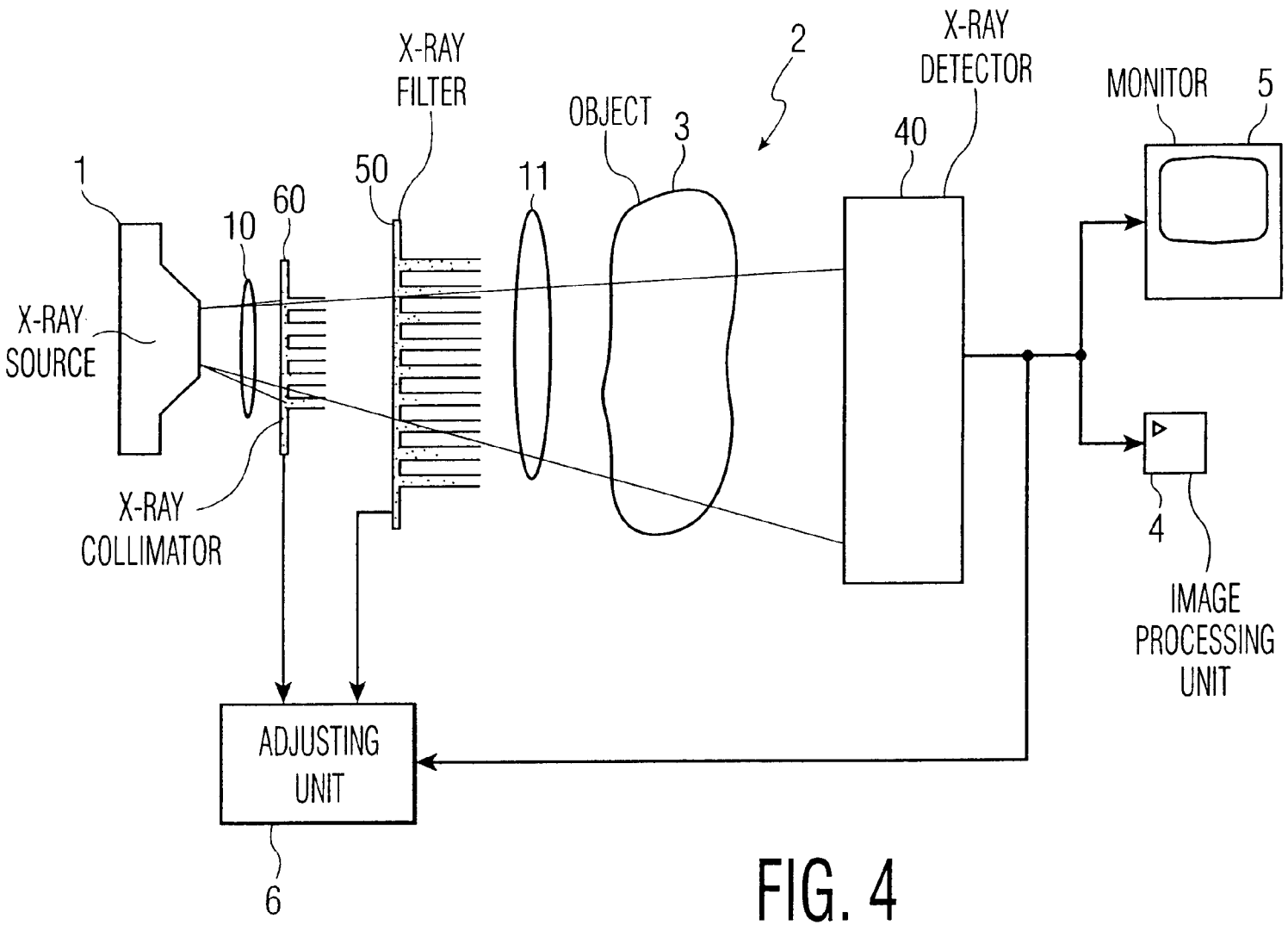

FIG. 4 shows an X-ray examination apparatus according to the invention in which the X-ray collimator 60 is arranged between the X-ray filter 50 and the X-ray source. The distance between the X-ray collimator and the X-ray source is much smaller than the distance between the X-ray detector and the X-ray source, and the X-ray beam is a conical beam whose cross-section near the X-ray detector is much larger than its cross-section near the X-ray collimator. Because neighboring collimator elements 61 are in the X-ray transmitting state and in the X-ray intercepting state, intensity modulations occur in the X-ray beam 11 over short distances of from approximately 100 $\mu$m to 500 $\mu$m in the direction transversely of the X-ray beam. At the area of the X-ray detector these modulations have been spread over a few centimeters by the diverging limited X-ray beam 11 and the modulation depth of the modulations has become negligibly small at the area of the X-ray detector.

Figure 5:
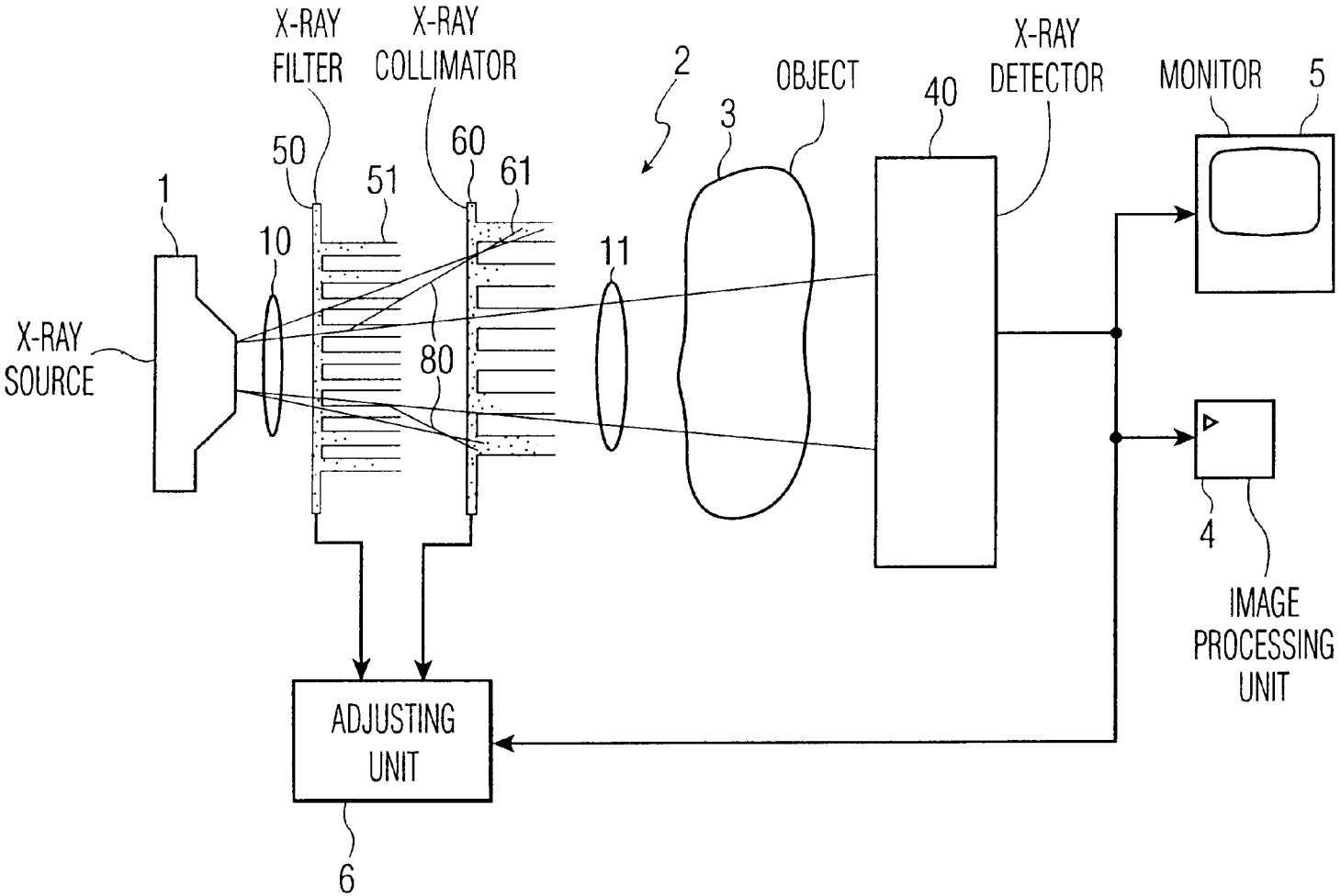

FIG. 5 shows an X-ray examination apparatus according to the invention in which the X-ray collimator 60 is arranged between the X-ray filter 50 and the examination space 2. In this configuration it is achieved that X-rays scattered by the X-ray filter, for example the scattered X-rays 80, are intercepted by the X-ray collimator. Because the X-rays scattered by the X-ray filter cannot reach the X-ray detector, disturbances of the X-ray image by scattered X-rays, notably the so-called blurring, are counteracted.

All references cited herein are incorporated herein by reference in their entirety and for all purposes to the same extent as if each individual publication or patent or patent application was specifically and individually indicated to be incorporated by reference in its entirety for all purposes.

What is claimed is:

1. An X-ray examination apparatus comprising an X-ray source for emitting X-rays, an examination space for receiving an object to be radiologically examined, an X-ray detector for deriving an image signal from an X-ray image of the object, an X-ray filter for locally attenuating the X-rays, said X-ray filter is arranged between the X-ray source and the X-ray detector, and is provided with filter elements whose X-ray absorptivity can be adjusted on the basis of a quantity of X-ray absorbing liquid within the individual filter elements, and an X-ray collimator for locally intercepting the X-rays, said X-ray collimator is arranged between the X-ray source and the examination space, and is provided with collimator elements which can be switched between an X-ray transmitting state and an X-ray intercepting state, individual collimator elements being filled with an X-ray intercepting liquid in the X-ray intercepting state.

2. An X-ray examination apparatus as claimed in claim 1, wherein the X-ray intercepting liquid is a liquid metal or a liquid metal alloy.

3. An X-ray examination apparatus as claimed in claim 2, wherein the liquid metal or liquid metal alloy contains a material from the group mercury and gallium.

4. An X-ray examination apparatus as claimed in claim 1, wherein the filter elements are formed by a filter group of capillary tubes, wherein the collimator elements are formed by a collimator group of capillary tubes, and wherein the capillary tubes of the collimator group are shorter than the capillary tubes of the filter group.

5. An X-ray examination apparatus as claimed in claim 4, wherein the length of the capillary tubes of the collimator group is less than ⅓ of the length of the capillary tubes of the filter group.

6. An X-ray examination apparatus as claimed in claim 1, wherein the number of collimator elements is smaller than the number of filter elements.

7. An X-ray examination apparatus as claimed in claim 1, wherein the collimator elements communicate with a common duct, and wherein the X-ray collimator is provided with an evacuation system for controlling the quantity of X-ray intercepting liquid in the common duct.

8. An X-ray examination apparatus as claimed in claim 7, wherein the common duct can be distorted so as to change the volume of the common duct.

9. An X-ray examination apparatus as claimed in claim 7, wherein the common duct has a deformable wall.

10. An X-ray examination apparatus as claimed in claim 1, wherein the X-ray collimator is arranged between the X-ray filter and the examination space.

11. An X-ray examination apparatus as claimed in claim 1, wherein the X-ray filter is arranged between the X-ray collimator and the examination space.

* * * * *